United States Patent [19]

Ribarev et al.

[11] Patent Number: 4,781,039

[45] Date of Patent: Nov. 1, 1988

[54] CIRCULAR KNIT WITH WARP KNIT STRUCTURE AND METHOD OF MAKING SAME

[75] Inventors: Bojidar P. Ribarev; Savko T. Petrov; Veselin G. Mintchev; Kiril L. Kirilov; Yordanka P. Ribareva; Boryana B. Ribareva; Hristo D. Popov, all of Sofia, Bulgaria

[73] Assignee: Institute Po Obleklo I Tekstil, Sofia, Bulgaria

[21] Appl. No.: 87,959

[22] Filed: Aug. 17, 1987

Related U.S. Application Data

[63] Continuation of Ser. No. 820,933, Jan. 21, 1986.

[30] Foreign Application Priority Data

Jan. 22, 1985 [BG] Bulgaria ..... 68484

[51] Int. Cl.[4] ..... D04B 9/12

[52] U.S. Cl. ..... 66/9 A

[58] Field of Search ..... 66/81, 8, 9 A

[56] References Cited

U.S. PATENT DOCUMENTS

| | | | |
|---|---|---|---|
| 3,522,715 | 8/1970 | Merritt et al. | 66/81 X |
| 3,566,618 | 3/1971 | Merritt | 66/81 X |
| 3,570,268 | 3/1971 | Nogues | 66/81 |
| 3,693,378 | 9/1972 | Nogues | 66/81 |
| 3,760,606 | 9/1973 | Greszin . | |
| 3,859,825 | 1/1975 | Foulgies . | |
| 4,091,063 | 5/1978 | Logan . | |
| 4,123,830 | 11/1978 | Matsuda et al. | 66/195 X |
| 4,270,368 | 6/1981 | Ragoza et al. | 66/81 |
| 4,312,260 | 1/1982 | Morieras . | |

FOREIGN PATENT DOCUMENTS

| | | |
|---|---|---|
| 18304 | 1/1972 | Bulgaria . |
| 32944 | 11/1982 | Bulgaria . |

*Primary Examiner*—Ronald Feldbaum
*Attorney, Agent, or Firm*—Herbert Dubno

[57] ABSTRACT

A knitted covering for a core, e.g. of hose or electrical cable or the like, is constituted as a circular warp knit in which each of a single system of warp yarns jumps over at least one and less than all of the wales of the system in passing from course to course. A method of making the knitted core covering is also described.

3 Claims, 21 Drawing Sheets

$$\frac{1-0=1}{2-3-2}$$

1 − 0 − 1

3 − 4 − 3

$$\frac{1-0-1}{4-5-4}$$

$$\frac{1-0-1}{5-6-5}$$

$$\frac{1-0-1}{6-7-6}$$

1 — 0 — 1

7 — 1 — 7

CIRCULAR KNIT WITH WARP KNIT STRUCTURE AND METHOD OF MAKING SAME

This is a continuation of co-pending application Ser. No. 820,933 filed on Jan. 2, 1986.

FIELD OF THE INVENTION

The present invention relates to circular knitted goods with a warp knit structure and to a method of making same. More particularly the invention has application for the production of flexible cylindrical hollow or core articles, e.g. insulating, screened, coated electrical and optical cables, cords, elastic cords, yacht ropes, ropes for alpinism and spelaeology of the knitkern mantle type, clad highpressure hoses, cylindrical packings, etc.

BACKGROUND OF THE INVENTION

Circular knitted products with a warp knitted structure are known (Bulgarian Author's Certificate No. 18304), these products being made of stitch wales, connected by means of longitudinal bonds, and a tuft of filling threads being inserted between the said stitch wales. A disadvantage of these circular knitted goods is that each longitudinal bond connects two adjoining stitch wales, which leads to low longitudinal elasticity and a high transverse deformation, as well as to weak cohesion with the core.

A method is known for making these circular knitted goods, wherein after a simultaneous lifting of all knitting needles, to every two needles consecutively is fed one and the same warp yarn inserted by means of an eye needle guide making a circular reciprocating movement immediately above a needle cylinder.

A disadvantage of this method is that by feeding consecutively the yarn to every two, three or more needles, the yarn is subjected to a higher tension leading to high tearability and corresponding downtime during the process and deterioration of the quality.

Another circular knitted product (Bulgarian Author's Certificate No. 32944) is known, wherein the stitch wales around the core are diametrically connected two by two.

A disadvantage of such circular knitted goods is that its warp knitted structure has specified physical and mechanical, technological and color matching parameters, i.e. cross and longitudinal strength, cross and longitudinal elasticity, molulus of longitudinal bending, porosity, cohesion with the core, etc. below those which are desirable. These circular knitted goods have even numbers of stitch wales. A method is known for making the circular knitted goods of Bulgarian Author's Certificate No. 32944, wherein after a simultaneous lifting of all the needles, the warp yarns are fed around the core circularly and reciprocatively as during the circular reciprocating movement of the warp yarns each is knitted with the diametrically opposite yarn.

A disadvantage of this method is that the system of warp yarns is rotated reciprocatively with a constant angle of 180°, so that the method is applicable only to a system of even number warp yarns, and as a result only one type of warp knitted structure can be achieved, i.e. the loop bonds must be diametrically situated.

OBJECT OF THE INVENTION

It is therefore an object of this invention to provide a circular knit product with a warp knit structure with higher strength, improved longitudinal elasticity and ohmic resistance, higher modulus of longitudinal bending, greater cohesion with a core, a possibility of color matching and decreased porosity, as well as a method of making same from a system of an arbitrary number of warp yarns, making a variety of different types and qualities of knitted structure possible.

SUMMARY OF THE INVENTION

This object is attained by making a circular knitted product with a warp knit structure by forming a system of warp yarns with stitch wales and loop links, in which according to the present invention the system of yarns consists of 1 up to n number of yarns, and these yarns at every stitch course alternately omits from 1 to N−1 stitch wales, where N is greater than 1.

The product is produced by a method of making circular knitted products with a warp knit structure, wherein all knitting needles are simultaneously lifted and then every needle is overlapped with a separate yarn and the needles are drawn below the knocking over point and knitting one stitch course, according to the invention the separate yarn is fed upon an arbitrarily chosen needle, after a preliminary turning of the yarn at a given angle di which is in a direct ratio the number of the omitted needles and in indirect ratio to the total number of needles and is defined by the equation $$di = \frac{(Mi + 1) \cdot 360^\circ}{N} + K^\circ,$$

where Mi is the number of the missed (omitted)o needles, N is the total number of needles over 360° along the circumference, and K° is a constant and the number of the missed needles Mi varies in the range of 1 to N−1.

The advantages of the invention are that it is possible to produce a wide variety of warp knit structures with the desired different physical and mechanical, technological and color matching parameters, e.g. transverse and longitudinal strength, transverse and longitudinal elasticity, modulus of longitudinal bending, cohesion with the core, ohmic resistance, porosity and others, making them applicable for different types of rigid or flexible tubular goods, highpressure tubes and hoses, electrical and optical cables, ropes of knitkernmantle type, elastic cords, cords, etc.

SPECIFIC DESCRIPTION

According to FIGS. 1 to 6 a circular knitted product with a warp knit structure comprises a system of warp yarns 1', 2', 3', 4', 5', 6' and 7' formed into stitch wales 1'', 2'', 3'', 4'', 5'', 6'', 7'' and loop bonds 1''', 2''', 3''', 4''', 5''', 6''', and 7''' in stitch courses I, II, III and IV.

Figure 1:
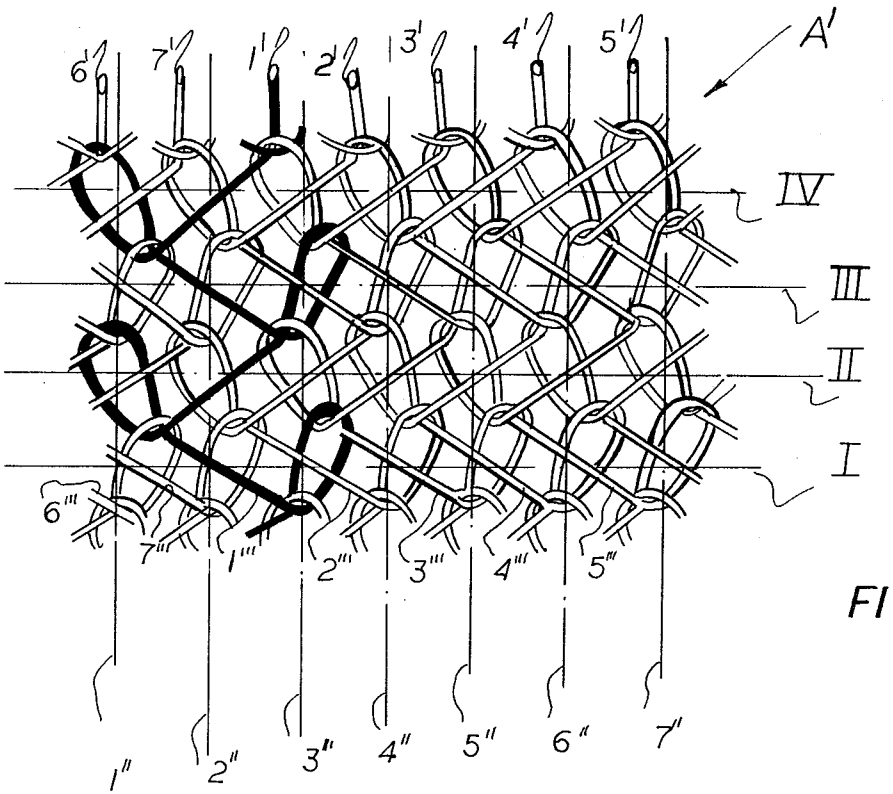
FIGS. 1, 2, 3, 4, 5, and 6 are diagrams showing six circularly knit products with a warp knit structure over seven needles.

According to FIG. 1 the loop bond 1''' omits (i.e. crosses without connecting) the stitch wale 2'' and connects alternatively the stitch wales 1'' and 3'' between each two stitch courses.

Figure 2:
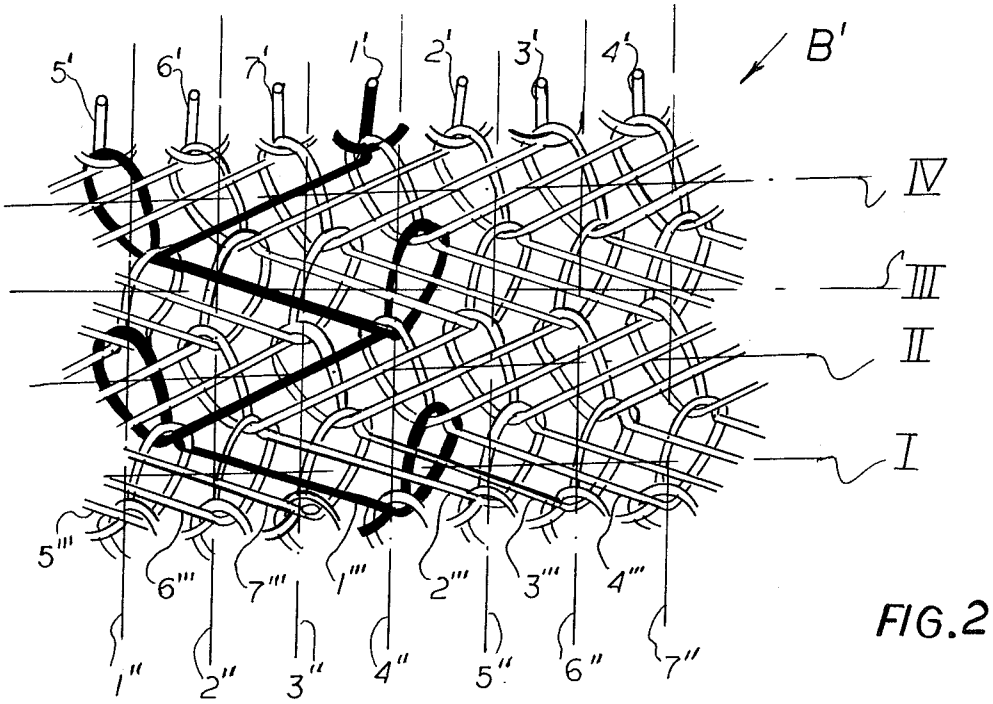

According to FIG. 2 the loop bond 1''' omits (i.e. crosses) the stitch wales 1'' and 4'' between each two stitch courses.

Figure 3:
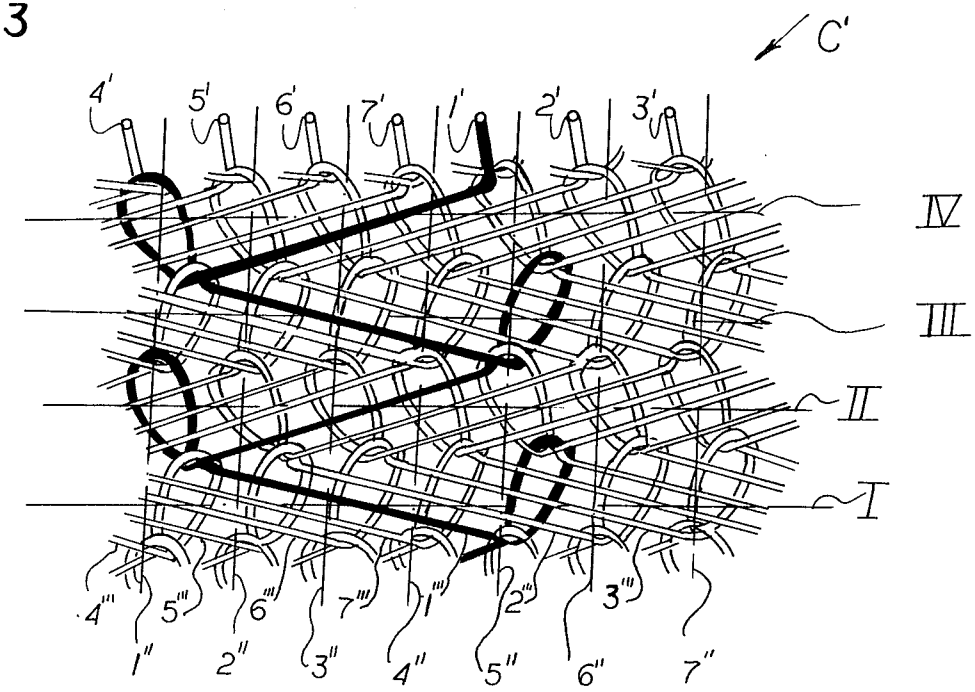

According to FIG. 3 the loop link 1''' omits the stitch wales 2'', 3'' and 4'' and connects alternatively the stitch wales 1'' and 5'' every two stitch courses.

Figure 4:
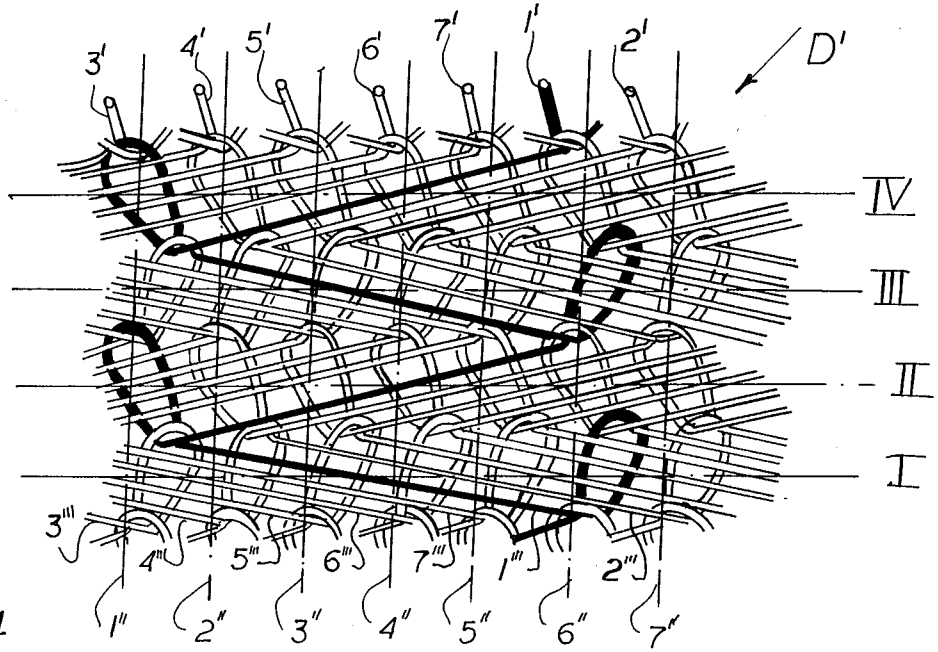

According to FIG. 4 the loop link 1''' omits the stitch wales, 2'', 3'', 4'' and 5'' and connects alternatively the stitch wales 1'' and 6'' every two stitch courses.

Figure 5:
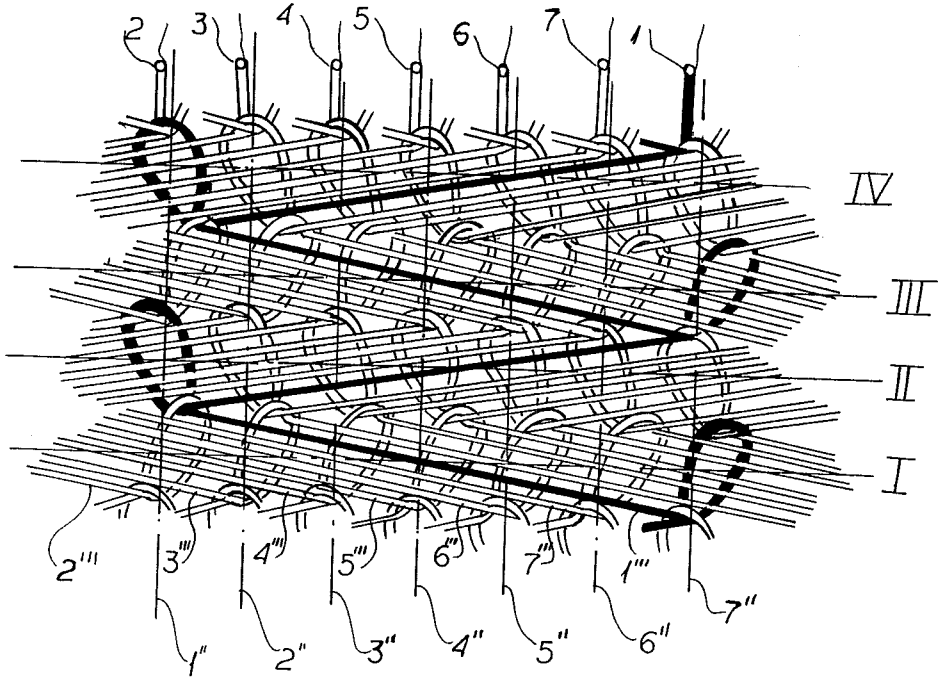

According to FIG. 5 the loop link 1'' omits the stitch wales, 2'', 3'', 4'' 5'' and 6'' and connects alternatively the stitch wales 1'' and 7'' every two stitch courses.

Figure 6:
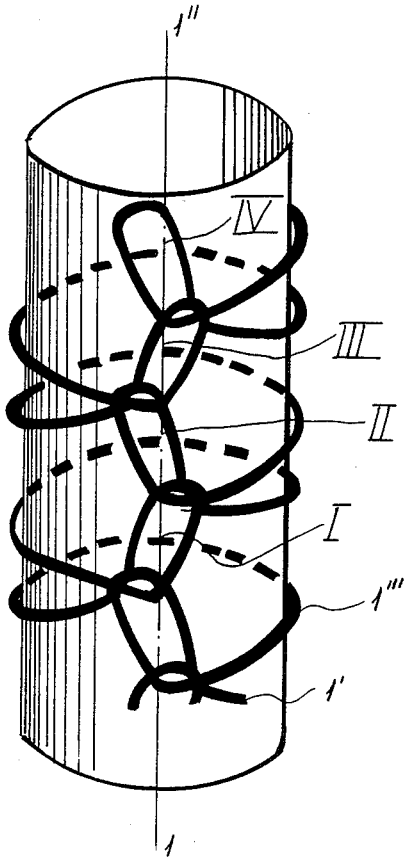

According to FIG. 6 the loop link 1''' omits all of the stitch wales, 2'', 3'', 4'' 5'' 6'' and 7'' (not shown in the figure) and connects alternatively from left and right only successive stitches of the stitch wale 1''.

For clarity the circular structure has been shown opened out in FIGS. 1–5 but axionometrically in FIG. 6.

According to FIGS. 7 to 12 the method for making the circular knit products with warp knit structures of FIGS. 1 to 6 is carried out as follows: the needles 1, 2, 3, 4, 5, 6, and 7 are in upper working positions, as each needle is fed respectively each with yarn from the warp system 1',2', 3', 4', 5', 6' and 7'; only one yarn 1' is shown in each case.

Figure 7:
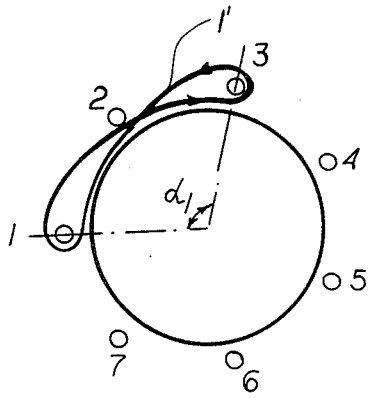
FIGS. 7, 8, 9, 10, 11 and 12 are knitting pattern diagrams which illustrate the method of making circular knitted goods according to FIGS. 1 to 6, respectively.

In the case of FIG. 7 the yarn 1' is fed around the back of the raised needle 3 and then across the front thereof, then the needles (1, 2, 3, 4, 5, 6, 7) are moved below the knocking over point (not shown), and stitch course I is knitted according to FIG. 1. The needles (1, 2, 3, 4, 5, 6, 7) are then lifted, accompanied by a simultaneous turning of the yarns 1', 2', 3', 5', 6' and 7' at an angle $$\alpha_1 = \frac{(1+1)\cdot 360^\circ}{7} + 20^\circ = 102.85^\circ + 20^\circ,$$

so that the illustrated yarn 1' misses the needle 2 and is fed to the needle 1, then all needles are dropped below the knocking over point knitting the stitch course II. The cycle is repeated in courses III and IV, etc.

Figure 8:
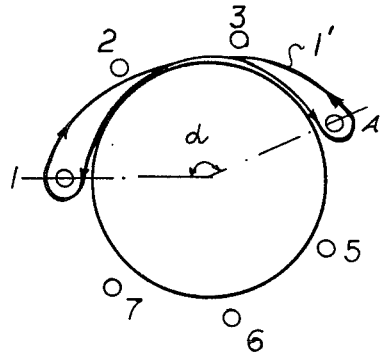

In FIG. 8 the yarn 1' is fed to the raised needle 4 around the back and then in front of it, than all needles are lowered below the knocking over point (not shown) knitting the stitch course I according to FIG. 2. After a repeated lifting of all needles shown, accompanied by a simultaneous turning of all yarns at an angle $$\alpha_2 = \frac{(2+1)\cdot 360^\circ}{7} + 20^\circ = 154.29^\circ + 20^\circ,$$

the yarn 1' misses needles 3 and 2 and is fed to the needle 1, then all needles are dropped below the knocking over point and knit stitch course II, etc.

Figure 9:
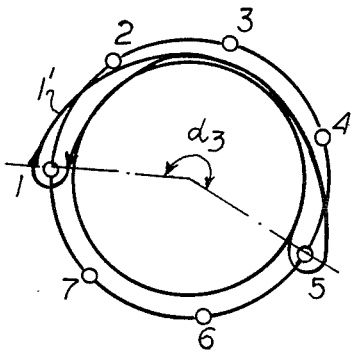
Figure 10:
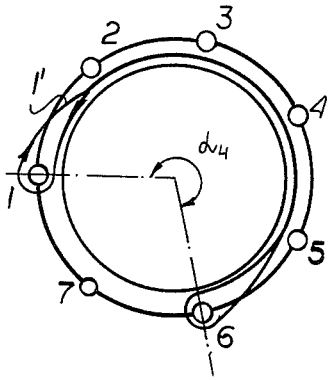

In FIG. 9 the yarn 1' is fed to the needle 5 around the back and then in front of it, then all needles are lowered below the knocking over point knitting the stitch course I according to FIG. 3. There follows a repeated lifting of all needles shown, accompanied by a simultaneous turning of all yarns at an angle $$\alpha_3 = \frac{(3+1)\cdot 360^\circ}{7} + 20^\circ = 205.71^\circ + 20^\circ,$$

as the yarn 1' misses the needles 4, 3, 2, and is fed to the needle 1; then all the needles are lowered below the knocking over point knitting the stitch course II, etc. In FIG. 10 the yarn 1' is fed to the needle 6, then all needles are taken below the knocking over point knitting stitch course I according to FIG. 4. A second lifting of all needles follows, accompanied by a simultaneous turning of all yarns at an angle $$\alpha_4 = \frac{(4+1)\cdot 360^\circ}{7} + 20 = 257.14^\circ + 20^\circ,$$

so that the yarn 1' will pass the needles 5, 4, 3, and 2 and is fed to the needle 1; then all the needles are lowered below the knocking over point, knitting stitch course II, etc.

Figure 11:
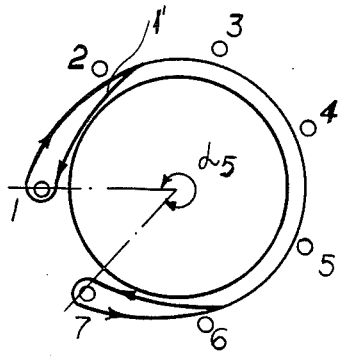

In FIG. 11 yarn 1' is similarly fed to the needle 7 then all the needles are taken below the knocking over point, knitting stitch course I according to FIG. 5. Following a second lifting of all the needles, accompanied by a simultaneous turning of all yarns at an angle $$\alpha_5 = \frac{(5+1)\cdot 360^\circ}{7} + 20 = 308.57^\circ + 20^\circ,$$

the yarn 1' misses the needles 6, 5, 4, 3, and 2 and is fed to the needle 1; then all the needles are lowered past the knocking over point knitting stitch course II.

Figure 12:
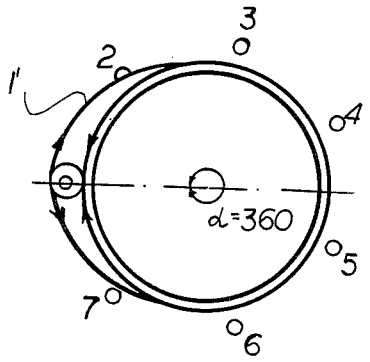

In FIG. 12 the yarn 1' is fed to the needle 1, then all the needles are lowered beneath the knocking over point as stitch course I is knitted according to FIG. 6. There follows a second lifting of all needles accompanied by a simultaneous turning of all yarns at an angle $$\alpha_6 = \frac{(6+1)\cdot 360^\circ}{7} + 20 = 360^\circ + 20^\circ,$$

as the yarn 1' misses the needles 7, 6, 5, and onto the needle 1; then all the needles are lowered beneath the knocking over point, knitting stitch course III, etc.

Figure 13:
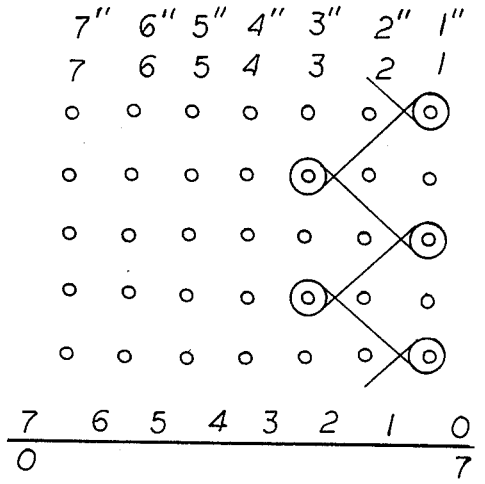
FIGS. 13, 14, 15, 16, 17 and 18 are graphic and analytical point-paper diagrams showing the making of the circular knitted products according to the method illustrated by FIGS. 7 to 12.

FIG. 13 illustrates a point-paper diagram for obtaining the circular knitted product of FIG. 1 according to the method illustrated in FIG. 7.

Figure 14:
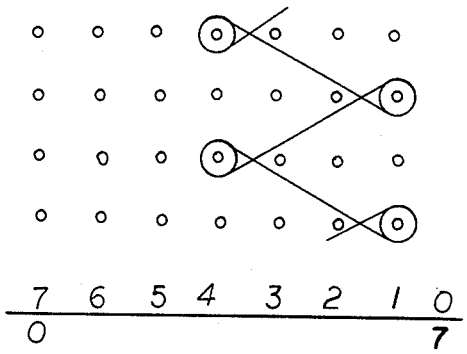

FIG. 14 is a point-paper diagram for achieving the circular knitted product of FIG. 2 according to the method illustrated in FIG. 8.

Figure 15:
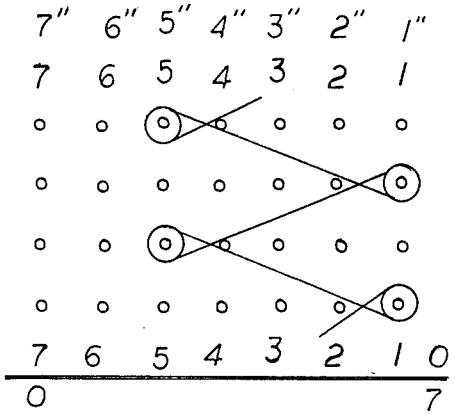

FIG. 15 is a similar diagram for making the circular knitted product of FIG. 3 according to the method illustrated in FIG. 9.

Figure 16:
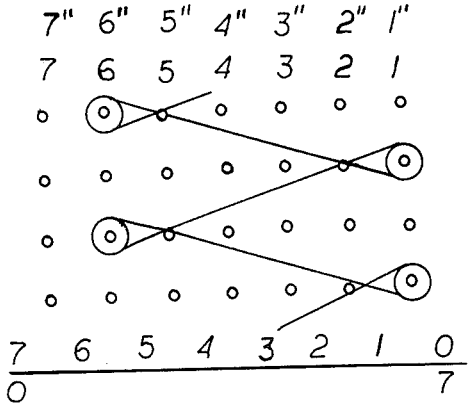

FIG. 16 is a point-paper diagram for making the circular knitted product of FIG. 4 according to the method illustrated in FIG. 10.

Figure 17:
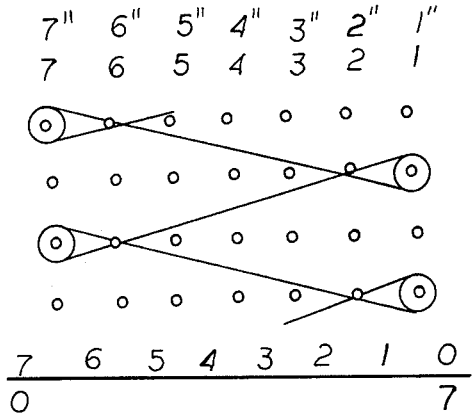

FIG. 17 is a similar diagram for making the circular knitted product of FIG. 5 according to the method illustrated in FIG. 11.

Figure 18:
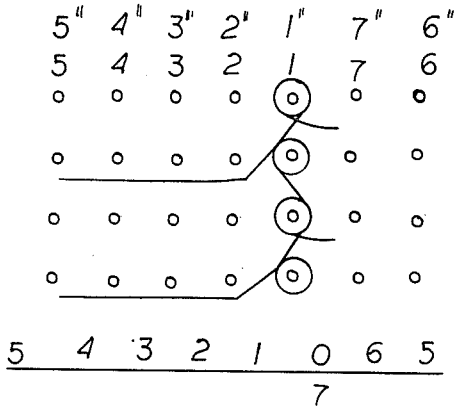

In FIG. 18 we have shown a point-paper diagram for making the circular knitted product of FIG. 6 according to the method illustrated in FIG. 12.

Figure 19:
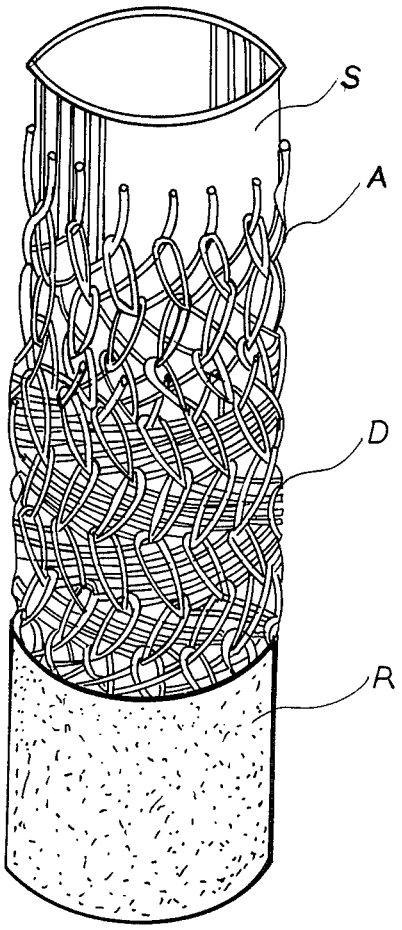
FIGS. 19, 20 and 21 are elevational views, partly broken away, showing application of the knitted goods according to the invention, respectively as coated highpressure hose, as an electrically insulated and screened cable, and as a rope of the knit kernmantel type.

FIG. 19 shows a coated flexible hose consisting of an inner tube S upon which is knitted a warp knit cover A made of a thread type material including a system of yarns, as each of those yarns at every stitch course misses one stitch wale, i.e. the knitted product illustrated in FIG. 1.

Figure 20:
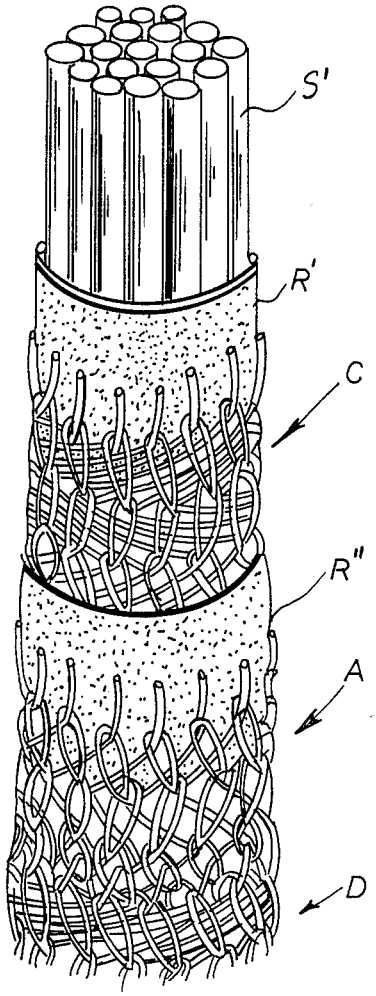

Upon the warp knit cover A is knitted another warp knit cover D, including a system of yarns, as each of those yarns at every stitch course misses four stitch wales, i.e. the knitted sheath illustrated in FIG. 4. Upon the warp knit cover D is coated an elastic sheath R. FIG. 20 shows an electric cable insulated, screened and wrapped with circular knitted goods, consisting of electric wires S' (multiple cable) coated with flexible elastic coating R'. Upon the coating R' is knitted warp knit cover C from threadlike insulating material comprising a system of yarns, so that each of those yarns at every stitch course misses three stitch wales, i.e. the knitted product of FIG. 3.

Upon the warp knit cover C is applied another flexible elastic coating R". Upon the elastic coating R" is knitted another warp knit cover A from a threadlike electroconductive material comprising a system of yarns, as each of those yarns at every stitch course misses one stitch wale, i.e. the knitted product illustrated in FIG. 1. Upon the electroconductive warp knit cover A is knitted still another warp knit cover D from a threadlike durable material, comprising a system of yarns, as each of those yarns at every stitch course misses four stitch wales, i.e. the knitted product illustrated in FIG. 4.

Figure 21:
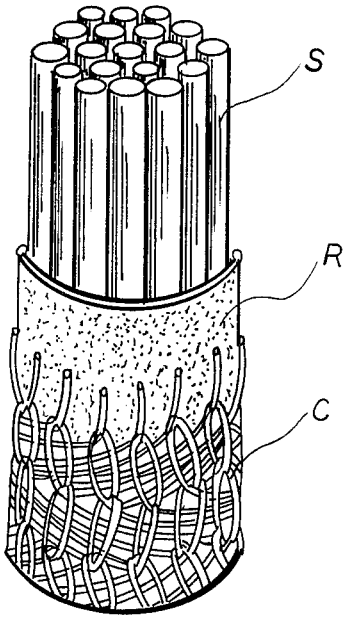

According to FIG. 21 a rope of the knit kernmantle type consists of super tight yarns S upon which is applied flexible elastic coating R. Upon the coating R is knitted a warp knit cover C from a reinforced durable threadlike material, comprising a system of yarns, as each of those yarns at every stitch course misses three stitch wales, i.e. the knitted good illustrated in FIG. 3.

For the exemplary executions is chosen the case of applying a system of seven (1,2,3,4,5,6 and 7) knitting needles, seven (1', 2', 3', 4', 5', 6' and 7') knitting yarns, seven (1", 2", 3", 4", 5", 6" and 7") stitch wales and seven (1"', 2"', 3"', 4"', 5"', 6"' and 7"') loop links or bonds, i.e. N=7, although the principle is valid only for an arbitrary chosen number of needles N and their corresponding N' knitting yarns, N" stitch wales and N"' loop links at a respective constant angle K° of the used equipment, as Mi is the number of the missed needless or missed stitch wales. Thus by changing the angle $$\alpha_i = \frac{(Mi + 1) \cdot 360°}{N} + K°$$

the number of circular knitted goods is N−1, where N=1.

The exemplary articles illustrated in the enclosed figures, where circular knitted goods are applied and the method of making same do not confine the production of the other types of articles with different features and applications, so that the separate warp knitted covers (coatings) may be used in different combinations depending upon the requirements and aims of the consumer.

We claim:

1. An article of manufacture comprising:

a flexible tubular core;

at least one knitted covering on said core, said covering consisting of a single system of seven warp yarns warp knitted in wales extending longitudinally along said core and courses extending around said core with each of said warp yarns having wale loops knitted into wales in successive courses and extending between said wale loops over and without looping and interlocking with at least one and less than all of said wales between said successive courses.

2. An article of manufacture comprising:

a core;

at least one knitted covering on said core, said covering consisting of a single system of seven warp yarns warp knitted in wales extending longitudinally along said core and courses extending around said core with each of said warp yarns having wale loops knitted into wales in successive courses and extending between said wale loops over and without looping and interlocking with at least one and less than all of said wales between said successive courses; and another knitted covering on the first mentioned covering and also consisting of a single system of warp yarns, warp knitted in wales extending longitudinally along the article and courses extending therearound with each of the warp yarns of said other knitted covering extending over and without looping and interlocking with at least one and less than all of the wales thereof between successive courses.

3. A method of making an article of manufacture which comprises a core and at least one knitted covering on said core which comprises the steps of:

raising a circular array of knitting needles above a knocking-over point and feeding a respective warp yarn to each of said needles, said warp yarns constituting a single system adapted to be warp knitted by said needles into wales formed by each needle and extending along a core of the article, and courses extending around said cores, the warp yarns knitted into each wale being passed around the respective needle from back to front;

lowering said needles below said knocking-over point and knitting a course;

raising said needles above said knocking-over point and feeding each yarn to another needle passing at least one needle but less than all of said needles by imparting to each yarn a turn through an angle defined by the relationship $$\frac{(M_i + 1) \cdot 360°}{N} + K°.$$

where $M_1$ is the number of missed needles less than N and at least equal to 1, N is an odd number and the total number of needles spaced uniformly about 360° and K is a constant greater than 0, lowering said needles below said knocking-over point and knitting a successive course; and repeating the preceding steps in succession to knit said covering adapted to surround said core.

* * * * *